United States Patent [19]

Mikulin

[11] 4,174,572

[45] Nov. 20, 1979

[54] DRAFTING INSTRUMENT

[76] Inventor: Tom T. Mikulin, 601 Airport Blvd., South San Francisco, Calif. 94080

[21] Appl. No.: 918,801

[22] Filed: Jun. 26, 1978

[51] Int. Cl.[2] ..... B43L 11/04

[52] U.S. Cl. ..... 33/31

[58] Field of Search ..... 33/30, 31

[56] References Cited

U.S. PATENT DOCUMENTS

| | | | |
|---|---|---|---|
| 73,290 | 1/1868 | Bowly | 33/30 A |
| 873,291 | 12/1907 | Beck | 33/31 |
| 1,017,287 | 2/1912 | Gran et al. | 33/31 |

*Primary Examiner*—Harry N. Haroian

*Attorney, Agent, or Firm*—Flehr, Hohbach, Test, Albritton & Herbert

[57] ABSTRACT

A drafting instrument for tracing curves such as ellipses. The instrument includes a base which is movable over a graphics surface. A marking element is carried by a writing arm connected with the base by linkage means which guides the marking element along a predetermined curvilinear path. The linkage means includes a master arm pivotally mounted at one end on the base for sliding movement along the minor axis and pivotally mounted at its other end on the writing arm by an articulated joint which is adjustable along the writing arm to selectively vary the minor axis apex of the curve being drawn. The linkage means also includes a slave arm pivotally mounted between the base and a midportion of the master arm. Another articulated joint is mounted on the base for sliding movement along the minor axis and is adjustably connected with the writing arm for selectively varying the major axis apex of the curve being drawn. A handle and yoke arrangement is provided for normally holding the marking element in a raised stand-by position and causing the marking element to move downwardly into contact with the graphics surface as a force is applied to the handle for operating the instrument.

2 Claims, 8 Drawing Figures

DRAFTING INSTRUMENT

BACKGROUND OF THE INVENTION

This invention relates in general to drafting instruments, and in particular relates to instruments for drawing a family of curves such as ellipses.

Curves such as ellipses can be drawn by the use of templates having a plurality of cutouts for ellipses of different sizes and eccentricities. However, such templates have limited use because they cannot be used to draw ellipses of universal size and eccentricity.

Mechanical instruments for drawing ellipses, commonly called ellipsographs, have previously been provided. The prior ellipsographs commonly include a post on which a circular disc is mounted with the marking element carried about the post by a writing arm which contacts the edge of the disc to trace the ellipse. Eccentricity can be varied by adjustably tilting the disc relative to the post. Ellipsographs of the foregoing type have a number of disadvantages and limitations. The ellipse figures cannot be accurately drawn, especially where it is desired to draw a family of different size ellipses. A further limitation is that conventional ellipsographs, as well as templates, do not permit the drawing of ellipses having extreme eccentricities such as 5° ellipses or smaller. Such prior ellipsographs are also relatively complicated and expensive to design and construct and are not readily adaptable to high-volume, low-cost manufacture.

OBJECTS AND SUMMARY OF THE INVENTION

It is a general object of the invention to provide a new and improved drafting instrument for tracing curves such as ellipses.

Another object is to provide a drafting instrument of the type described which permits the drawing of ellipses of universal size and eccentricities with a high degree of accuracy.

Another object is to provide a drafting instrument of the type described which is relatively small, light-weight and compact and is easily portable, which is relatively simple in design and construction, and which is adaptable to high-volume, low-cost manufacture.

Another object is to provide a drafting instrument of the type described which facilitates rapid and accurate adjustment of the size and eccentricity of the ellipse which is to be drawn.

Another object is to provide a drafting instrument of the type described in which operation of the instrument through a handle simultaneously moves the marking element into contact with the graphics surface, and in which the marking element returns to a stand-by position away from the graphics surface when the instrument is not being operated.

The invention in summary includes a writing arm which carries a marking element along a curvilinear path by linkage means which in turn is carried by a movable base. The linkage means includes a master arm which is carried at its proximal end by the base and is connected at its distal end at a first point on the writing arm so as to guide the first point for linear movement along the major axis. The linkage means further includes a joint carried by the base and connected with a second point on the writing arm so as to guide the second point for linear movement along a minor axis orthogonal with the major axis. A handle and yoke are mounted on the writing arm so as to bias the marking element upwardly to a stand-by position and to permit the marking element to move down into contact with the graphics surface when a force is applied to the handle for operating the instrument.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
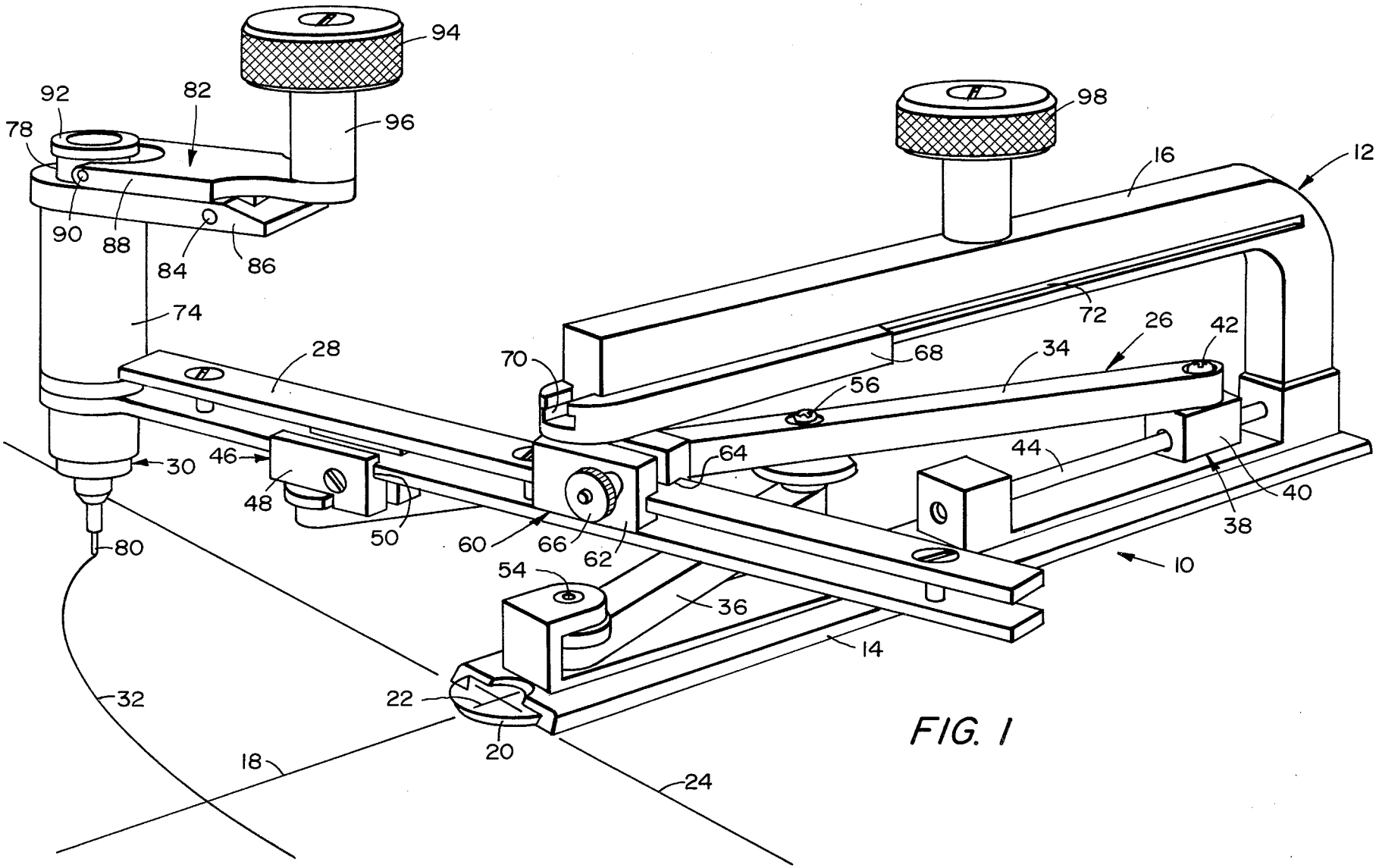
FIG. 1 is a perspective view of a drafting instrument according to the invention.
Figure 3:
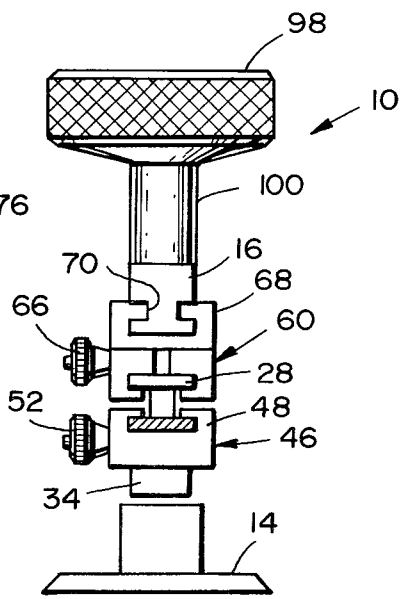
FIG. 3 is an end elevational view of the instrument taken along the line 3—3 of FIG. 2.
Figure 2:
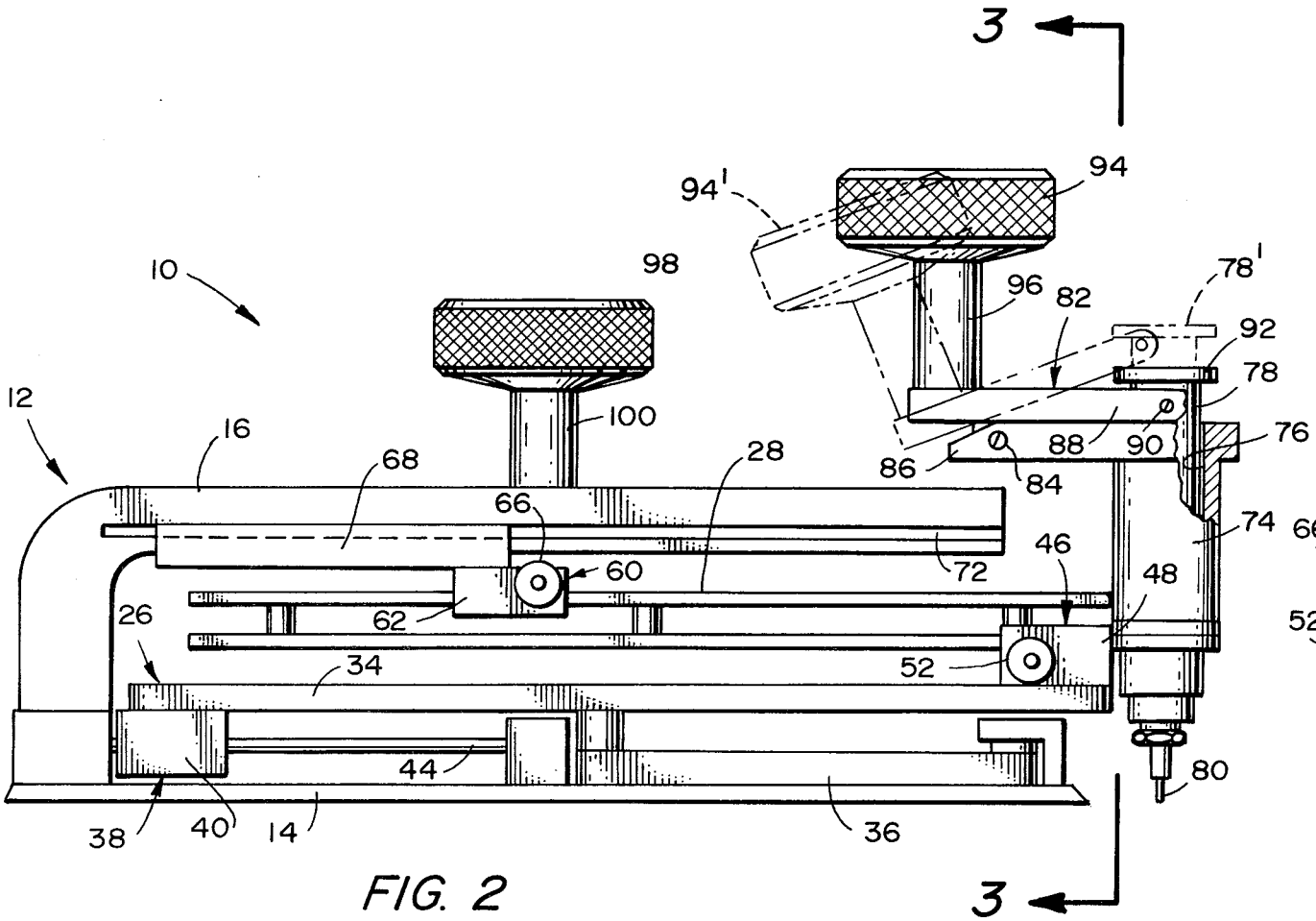
FIG. 2 is a side elevational view of the instrument of FIG. 1.

In the drawings FIGS. 1–4 illustrate generally at 10 a preferred embodiment of the drafting instrument according to the invention for drawing ellipses. Instrument 10 is relatively small and compact for portability and ease of use over a graphics surface such as on a drafting table. The various components of the instrument are adapted to be fabricated from light-weight material, e.g. aluminum, and by low-cost manufacturing techniques such as diecasting or the like. While the design and construction are simple, light-weight and inexpensive the instrument is capable of drawing highly accurate ellipses of universal size and eccentricity, within its range of limits, in the manner described hereafter.

Figure 4:
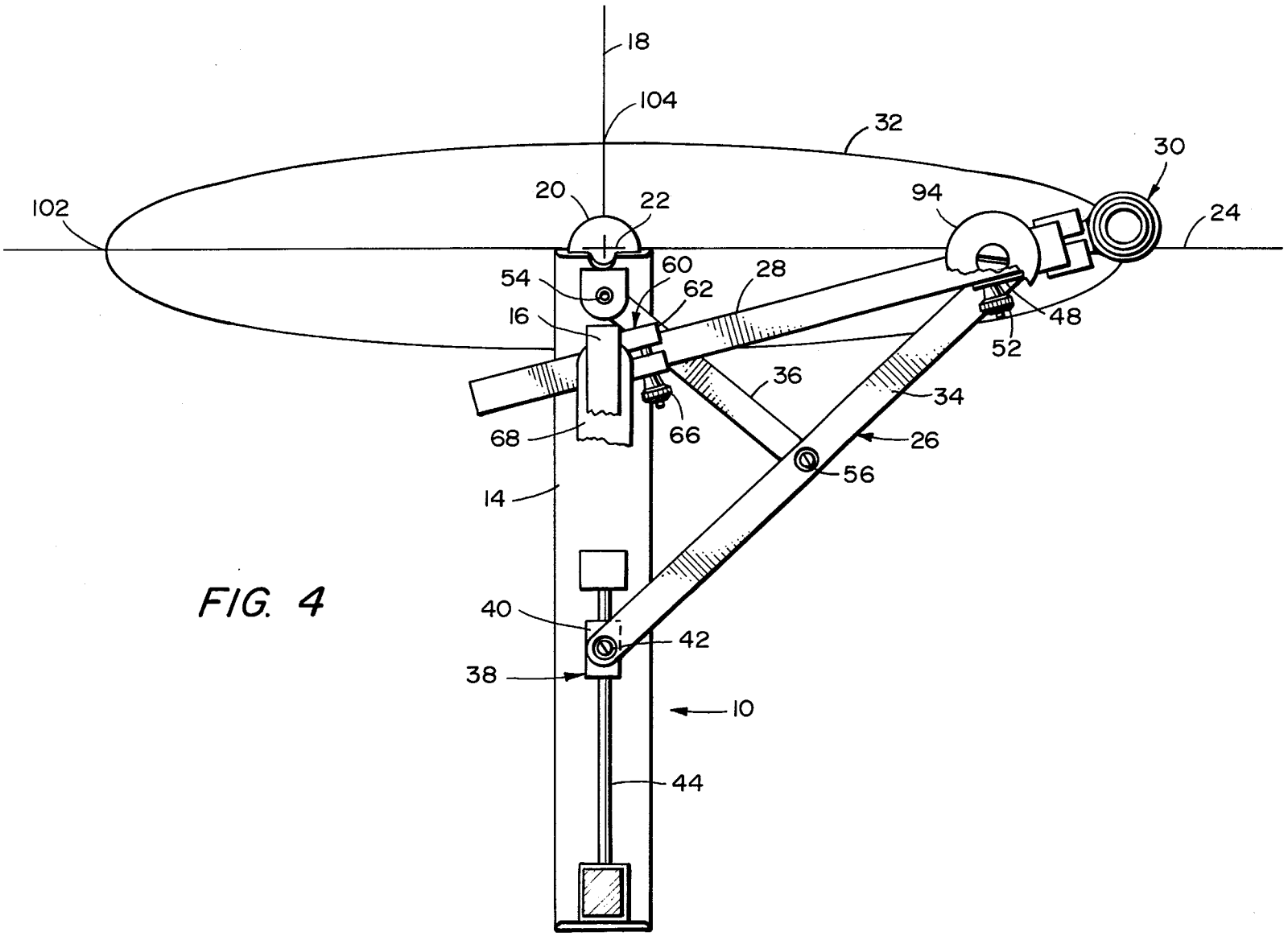
FIG. 4 is a top plan view, partially cut-away, of the instrument of FIG. 1.

Instrument 10 includes a U-shaped base 12 having a lower flat portion 14 which is supported on and can be moved over the graphics surface. Upper portion 16 of the base is spaced above and extends out over the lower portion. When set up for drawing an ellipse the draftsman aligns the upper and lower portions lengthwise along the minor axis 18 of the ellipse which is to be drawn, as shown in FIG. 4. A semi-circular transparent sighting piece 20 formed of clear plastic or the like is attached to the front of the base and is printed with crosshairs 22 for visual alignment over the center of the figure to be drawn and for alignment with the major axis 24 and minor axis 18.

The base mounts articulated linkage 26 which in turn carries a writing arm 28 and marking element 30 along a curvilinear path 32 over the graphics surface. The linkage includes a master arm 34 and slave arm 36 which are proportioned and interconnected between the base and writing arm such that the marking element is guided along an ellipse path. In the illustrated embodiment instrument 10 is adapted for drawing one-half of the ellipse in a single position of the base on the graphics surface. The remaining half of the ellipse can be completed by turning the instrument 180° about the ellipse center so that it is positioned on the opposite side of axis 24.

Master arm 34 of the linkage is mounted at its proximal end on the base through an articulated sliding connection 38 for movement lengthwise of the base, which is in a direction along the minor axis 18 of the curve being drawn. The sliding connection 38 comprises a block 40 pivotally mounted on the master arm by pin 42 and formed with a bore which is mounted for sliding movement along a horizontal guide rod 44 carried above the base lower portion. The distal end of the master arm is adjustably mounted at a selected first point 45 (FIG. 5) along the writing arm by an articulated joint 46. The joint 46 comprises a block 48 pivotally mounted to the writing arm and formed with a channel 50 which is adapted to be moved along the writing arm and secured at the selected point by means of a lock or set screw 52.

Figure 5:
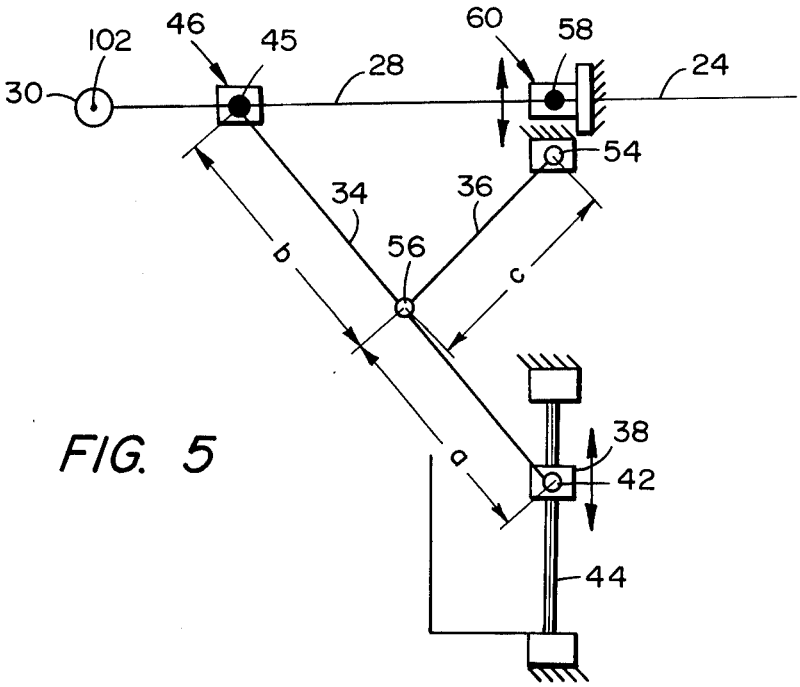
FIG. 5 is a schematic diagram showing one position of the instrument of FIG. 1.

Slave arm 36 is pivotally mounted at its distal end to a fixed point adjacent the end of the base lower portion 14 by means of a pivot pin 54. The distal end of the slave arm is pivotally mounted to a midportion of the master arm by means of pivot pin 56. The size and proportions of the master and slave arms and their points of interconnection are predetermined so that when the arms are conjointly pivoted the distal end of the master arm, and thereby the first point 45 on the writing arm, are guided for linear movement along the major axis 24 which is orthogonal with the minor axis. Referring to FIG. 5, where a is the proximal end length of the master arm from pin 56 to connection pin 42, b is the length of the distal end of the master arm from pin 56 to point 45, and c is the length of slave arm 36, then the ideal proportions are $a=b=c$ to produce linear movement of the point 45 along the major axis. For design considerations these proportions, however, are not preferred because the major axis would thereby be aligned across the slave arm pivot pin 54 such that when drawing ellipses having a minor axis vertex of small size the marking element would move too close to the pivot pin. Therefore for practical reasons the length b of the master arm is made greater than a so that the major axis clears pivot pin 54. In such case slave arm length c must be proportionally increased by one-half of the distance b minus a to achieve the desired movement of the first point 45 in a straight line along the major axis. For example, where length a is 9 cm and length b is 10 cm, then length c is made 8.5 cm.

A second selected point 58 on writing arm 28 is carried by the base upper portion through an articulated sliding joint 60 which guides the second point for linear movement along the minor axis. Joint 60 includes a block 62 formed with a channel 64 for sliding movement along the writing arm, and the block is secured at a selected point on the arm by means of a lock or set screw 66. The block is pivotally mounted below a carrier block 68 which is also formed with a channel 70 that slidably mounts in grooves 72 formed along the base upper portion.

Marking element 30 is carried from the distal end of the writing arm by means of a vertically axised cylinder 74 which is formed with a central bore 76. In the illustrated embodiment the marking element comprises a cylindrical cartridge 78 containing an ink reservoir and which carries a downwardly projecting ink pen 80. Other types of marking elements could be provided, for example, ball point or felt tip pens or lead pencils and the like. Cartridge 78 is carried within the bore for vertically sliding movement between the lowered operating position as shown in solid line in FIG. 2 and a raised stand-by position as shown in broken line at 78'.

Hand-operated means is provided for normally retaining the marking element in its stand-by position and for automatically lowering the element to its operating position with the tip in gravity contact with the graphics surface when the linkage is operated. The hand-operated means includes a yoke 82 mounted by a pin 84 for pivotal movement about a horizontal axis on an inwardly projecting extension 86 formed on the upper end of cylinder 74. A clevis-shaped portion 88 of the yoke extends on opposite sides of the upper end of cartridge 78, and a pair of inwardly projecting pins 90 carried by the clevis extend below shoulder 92 formed at the top of the cartridge. A handle 94 is carried by a post 96 on the end of the yoke which extends inwardly from pin 84. The yoke and handle are sized and proportioned so that the weight of the handle is sufficient to normally pivot the yoke backwardly to the position shown at 94' whereby the pins engage shoulder 92 and raise the marking element to its stand-by position. When the draftsman grasps the handle 94 and applies a force to move the writing arm and linkage, a forward component of that force pivots the yoke forwardly so that the pins move downwardly permitting the marking element to move by gravity to the operating position. The tip is thus rapidly and automatically brought into contact with the graphics surface for drawing the curve. When the force on the handle is released upon completion of the curve, the yoke is pivoted backwardly by gravity so that the tip is again raised off the surface. A second handle 98 is mounted on a post 100 above base upper portion 16, and the draftsman's other hand can grasp this handle and firmly hold the base on the graphics surface while the curve is drawn.

The use and operation of the invention is as follows. In explaining the operation, particular reference is made to the schematic diagrams of FIGS. 5 through 8 which illustrate the instrument in different modes of adjustment and in different positions of the elements.

Instrument 10 is initially placed on the graphics surface with the draftsman sighting on crosshairs 22 to align the longitudinal axis of the instrument with minor axis 18 of the curve to be drawn and with the crosshairs over the center of the curve. The instrument is next adjusted to set up the desired lengths of the vertices of the major and minor axes and thereby establish the size and eccentricity of the ellipse. The semi-major axis distance is adjusted first and this is accomplished by moving the writing arm 28, with the marking element raised, into alignment with the major axis in the manner shown in FIG. 5. Set screw 66 of joint 60 is unlocked and the writing arm is moved through the channel of block 62 along the major axis until the marking element is aligned over the desired major axis vertex 102. Set screw 66 is again locked so that the base is connected at the second point 58 on the writing arm which is at a predetermined distance from the marking element.

Figure 6:
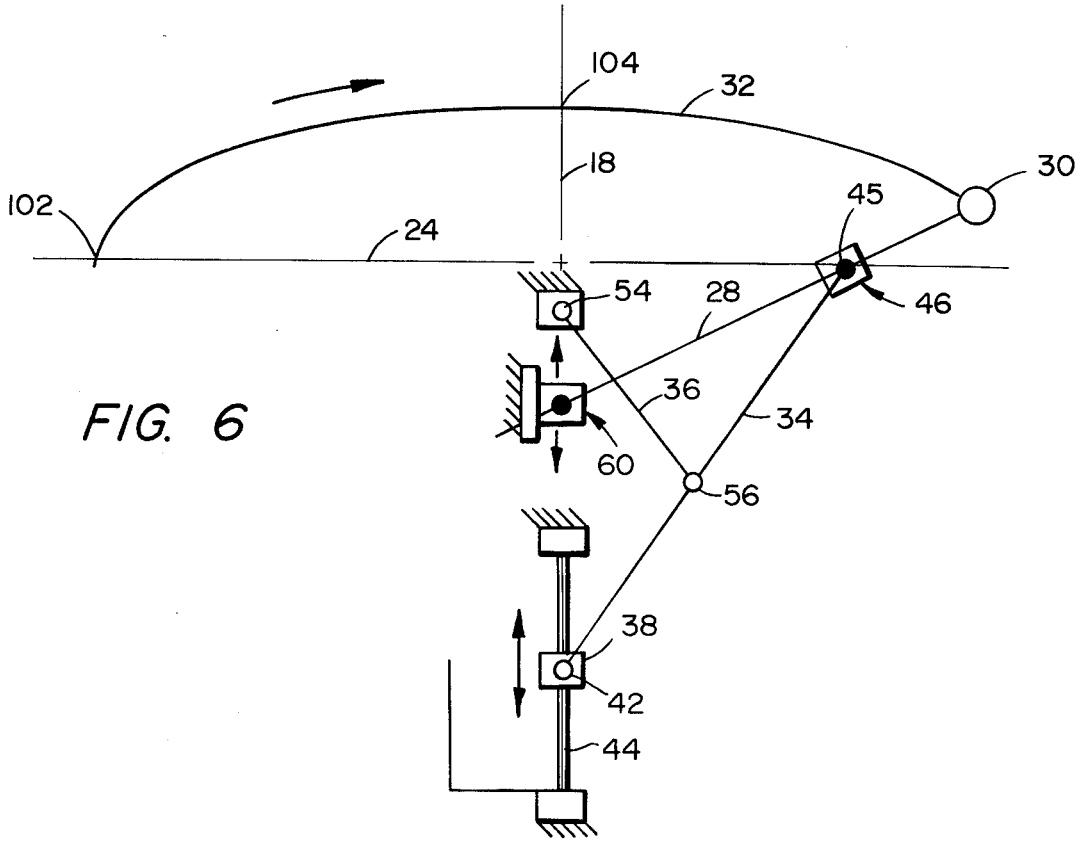
FIG. 6 is a schematic diagram similar to FIG. 5 showing the instrument in another position.

The semi-minor axis distance is next adjusted by moving the writing arm into alignment with the minor axis. Set screw 52 of joint 46 is rleased to unlock block 48 from the writing arm which is then moved relative to the block until the marking element is aligned over the desired minor axis vertex 104. It will be noted that as the writing arm is moved during this adjustment, articulated joint 60 is moved back and forth along base upper portion 16. Set screw 52 is again locked so that the first point 45 on the writing arm is set at a predetermined distance from the marking element. The curve is then drawn by applying downward pressure with one hand on handle 98 to hold the base on the surface while using the other hand to grasp and apply a force against handle 94 for moving the writing arm and marking element across the surface. As this force is applied yoke 82 is pivoted forward so that the marking element is free to move downwardly by gravity to its operating position with the tip in contact with the surface. As depicted by FIG. 6 movement of the writing arm from the initial position of FIG. 5 causes the master and slave arms to conjointly pivot and guide the first point 45 of joint 46 along the major axis while simultaneously guiding the second point 58 of joint 60 along the minor axis. This results in the marking element being guided along a path which defines an ellipse 32 having the preset major and minor axes vertices. One-half of the ellipse can be completely drawn with the instrument set up in one position, and where it is desired to complete the ellipse the instrument is turned through 180° on the opposite side of the major axis with the cross-hairs centered on the two axes. Without readjustment the writing arm is moved in the manner described to draw the bottom half of the ellipse.

Figure 7:
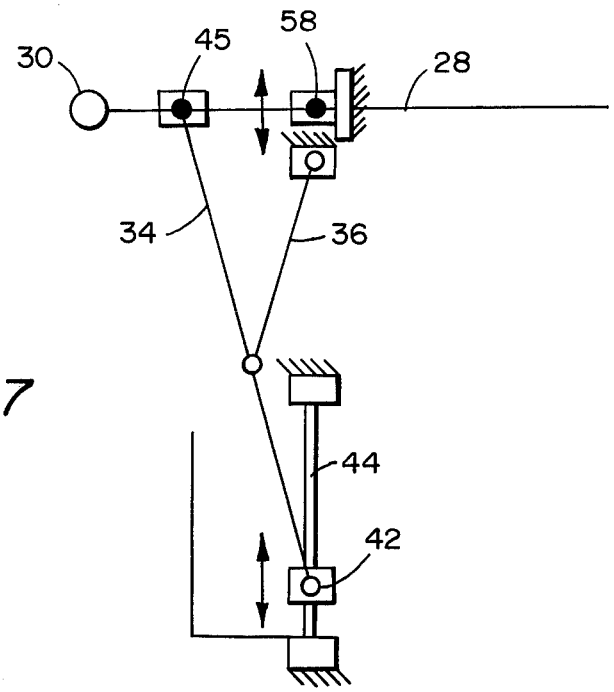
FIG. 7 is a schematic diagram similar to FIG. 5 showing still another position of the instrument.
Figure 8:
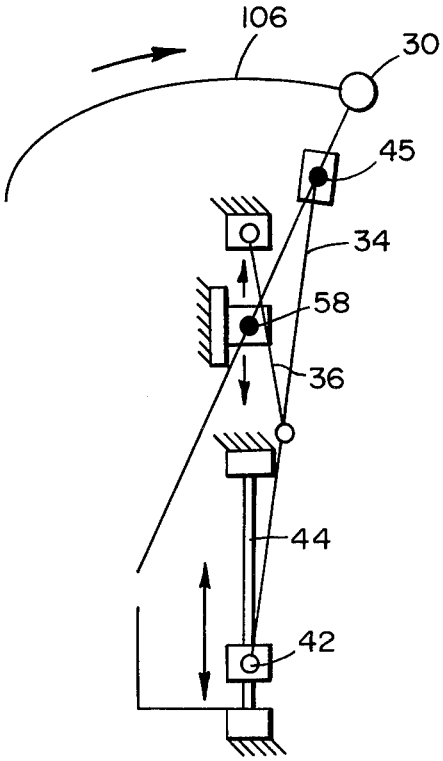
FIG. 8 is a schematic diagram similar to FIG. 5 illustrating yet another position of the instrument.

The instrument 10 can be adjusted to draw a wide range of ellipse sizes and eccentricities. FIGS. 5 and 6 illustrate adjustment of the instrument to draw a relatively small angle ellipse, i.e. an ellipse having an eccentricity with a relatively large major axis to minor axis vertices ratio. FIGS. 7 and 8 illustrate the adjustment for drawing a larger angle ellipse. In this case with the writing arm aligned along the major axis articulated joint 60 is adjusted so that the distance of second point 58 on the writing arm from the marking element is relatively small compared to the corresponding distance of FIG. 5. FIG. 8 illustrates the moved positions of the elements when the instrument is adjusted in FIG. 7 nears the end of drawing the half-ellipse 106.

From the foregoing it will be realized that applicant has provided a new and improved drafting instrument which is relatively simple in design, construction and operation. The instrument can be rapidly and easily adjusted for drawing ellipses of a wide range of sizes and eccentricities. Relatively small angle ellipses, of a size for which standard templates are not available, can be drawn with the present invention. The instrument is capable of drawing highly accurate curves, and drawing errors are not introduced when a series of different size ellipses are drawn, as can arise with prior art ellipsographs of the cam follower type. In addition the invention makes it possible to produce a drafting instrument which is ligh-weight, portable and relatively inexpensive.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A drafting instrument for tracing a curve, including the combination of a movable base, a writing arm having a distal end for carrying a marking element, linkage means connected between the base and writing arm for guiding the marking element along a curvilinear path, said linkage means including a master arm carried at its proximal end by the base and connected at its distal end at a first point on the writing arm which is spaced a first predetermined distance from the marking element for guiding the first point for linear movement along a major axis, joint means carried by the base and connected with a second point on the writing arm which is spaced a second predetermined distance from the marking element for guiding the second point for linear movement along a minor axis orthogonal with the major axis whereby conjoint pivotal movement between the writing arm and master arm guides the writing element along the curvilinear path, a marking element for tracing said curve on the graphics surface, means carried by the distal end of the writing arm for supporting the marking element for vertical movement, hand-operated means carried by the distal end of the writing arm for moving the marking element vertically between a raised stand-by position and a lowered operating position in contact with the graphics surface whereby with the marking element in its operating position the hand-operated means can be manipulated for moving the writing arm along the curvilinear path, the hand-operated means including a yoke mounted on the distal end of the writing arm for pivotal movement about a horizontal axis, said yoke being coupled with the marking element for vertically moving the latter, means forming a handle on the yoke, said yoke being biased by gravity to pivot about the horizontal axis in a direction which moves the marking element toward its stand-by position, said yoke being moved in an opposite direction about the axis for permitting movement of the marking element toward the operating position when a force is applied to the handle for operating the instrument.

2. A drafting instrument as in claim 1 which includes a vertically axised cylinder mounted on the distal end of the writing arm for guiding the marking element for vertical movement, means for pivotally mounting the yoke on a top margin of the cylinder radially spaced from the longitudinal centerline thereof, and said handle is mounted on the yoke on a side of the axis remote from the cylinder with the weight of the handle causing the yoke to be biased to pivot about the axis for moving the marking element toward its stand-by position.

* * * * *